US006533640B1

(12) United States Patent
Nopwaskey et al.

(10) Patent No.: US 6,533,640 B1
(45) Date of Patent: Mar. 18, 2003

(54) ULTRA HIGH PRESSURE ABRASIVE WATERJET CUTTING APPARATUS

(75) Inventors: Fred Charles Nopwaskey, San Jose, CA (US); Hsueh-Wen Pao, Saratoga, CA (US); Gary Allen Boortz, San Jose, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/461,500

(22) Filed: Dec. 14, 1999

(51) Int. Cl.[7] ..... B24C 3/00; B24B 49/00

(52) U.S. Cl. ..... 451/2; 451/24; 451/27; 451/36; 451/38; 451/76

(58) Field of Search ..... 451/2, 24, 27, 451/36, 38, 76

(56) References Cited

U.S. PATENT DOCUMENTS

| | | | |
|---|---|---|---|
| 2,985,050 A | 5/1961 | Schwacha | |
| 5,065,551 A | 11/1991 | Fraser | |
| 5,295,425 A | 3/1994 | Hediger | |
| 5,704,824 A | 1/1998 | Hashish et al. | |
| 5,778,713 A | 7/1998 | Butler et al. | |

FOREIGN PATENT DOCUMENTS

| | | | |
|---|---|---|---|
| EP | 0420787 A2 * | 9/1990 | ..... B26F/3/00 |
| EP | 1110670 A2 * | 6/2001 | ..... B24C/1/04 |

* cited by examiner

*Primary Examiner*—M. Rachuba
(74) *Attorney, Agent, or Firm*—Armstrong Teasdale LLP

(57) ABSTRACT

An ultra high pressure abrasive waterjet cutting apparatus for cutting nuclear reactor structural components is described. The cutting apparatus includes an ultra high pressure abrasive waterjet (UHP) cutting nozzle, movably coupled to a single axis manipulator, and a collection hood. The manipulator and the collection hood are coupled to a support frame and are configured to be positioned inside adjacent openings of a nuclear reactor top guide or core plate so that the cutting nozzle is in alignment with the collection hood. The manipulator includes a linear frame, a nozzle support plate movably coupled to the linear frame, and a motor operatively coupled to the nozzle support plate. The collection hood includes an elongate collection chamber having an elongate opening located so that the opening is in alignment with the cutting nozzle. The collection hood also includes at least one positioning cylinder coupled to the collection chamber and to the support frame which positions the collection chamber opening adjacent a top guide or core plate beam. The collection hood further includes an outlet port configured to be connected to a water filtration system.

13 Claims, 4 Drawing Sheets

ULTRA HIGH PRESSURE ABRASIVE WATERJET CUTTING APPARATUS

BACKGROUND OF THE INVENTION

This invention relates generally to cutting apparatus and more particularly to ultra high pressure abrasive waterjet cutting apparatus for cutting nuclear reactor structural components.

Structural components within nuclear reactor pressure vessels (RPV) become irradiated, and those components nearest the reactor core become highly irradiated. When such structural components require removal from the RPV and replacement, the components must be unbolted or cut from their original position and then subsequently cut into smaller sections for shipping and final storage. Because these components are radioactive, they must remain underwater to provide radiation shielding to workers in the proximity of the reactor components. The cutting process used to cut these structural components into smaller sections must therefore be performed underwater.

Known cutting apparatus for cutting reactor internals typically include a gantry type bridge with a partially submersible mast/manipulator attached. The gantry bridge and submersible manipulator permits from three to five axis of motion for the cutting nozzle. The disadvantages of these known cutting apparatus are that the gantry type bridge needs to be mounted on existing rails in the reactor, or new rails have to be installed. Because the cutting apparatus is mounted above the reactor internal components, it interferes with overhead crane cables when the crane is used for handling cut pieces of the reactor internal components. Additionally, the cutting apparatus interferes with the service platform which is used by personnel over the cutting area for manipulating rigging and cameras. Additionally, there is a possibility of the gantry running over hoses and power cables. It is also known that the mast/manipulator has stability problems when used with an ultra high pressure waterjet nozzle because of the force applied by the reaction to the ultra high pressure waterjet.

It would be desirable to provide a cutting apparatus for cutting reactor internal component parts in a nuclear reactor that does not include a gantry type bridge mounted on rails above the reactor.

BRIEF SUMMARY OF THE INVENTION

In an exemplary embodiment, an ultra high pressure abrasive waterjet cutting apparatus for cutting nuclear reactor structural components includes an ultra high pressure abrasive waterjet (UHP) cutting nozzle, movably coupled to a single axis manipulator, and a collection hood. The manipulator and the collection hood are configured to be positioned inside adjacent openings of a nuclear reactor top guide and/or a core plate so that the cutting nozzle is in alignment with the collection hood. The cutting apparatus also includes a support frame configured to engage the top surface of the top guide to support the apparatus. The manipulator is coupled to the support frame, and the collection hood is movably coupled to the support frame.

The manipulator includes a linear frame, a nozzle support plate movably coupled to the linear frame, and a motor operatively coupled to the nozzle support plate by a drive belt or ball screw. The motor moves the nozzle support plate along the linear frame. The cutting nozzle is coupled to the nozzle support plate.

The collection hood includes an elongate collection chamber having an elongate opening. The opening is located in the chamber so that the opening is in alignment with the cutting nozzle. The collection hood also includes at least one positioning cylinder coupled to the collection chamber and to the support frame. The at least one positioning cylinder is configured to position the collection chamber opening adjacent a top guide beam and/or a core plate beam. The collection hood further includes an outlet port configured to be connected to a water filtration system.

To cut up a reactor top guide, the ultra high pressure abrasive wateriest cutting apparatus is positioned in the reactor with the support frame resting on the top guide and the manipulator and collection hood in adjacent top guide openings. Typically, the manipulator and the collection hood are in a vertical position and are perpendicular to the top surface of the top guide. The positioning cylinders arc then activated to move the collection chamber into engagement with a top guide beam with the collection chamber opening adjacent the top guide beam and in alignment with the UHP nozzle on the opposite side of the top guide beam. The UHP nozzle is activated and the nozzle is moved from one end of the linear frame to the other end of the linear frame by activating the motor which moves the nozzle support plate along the linear frame. The abrasive containing UHP water jet cuts through the top guide beam enters the collection chamber through the opening adjacent the top guide beam. The water filtration system connected to the collection chamber outlet port filters the used abrasive and kerf material from the water before it is returned to the reactor.

The above described ultra high pressure abrasive waterjet cutting apparatus is supported by the reactor top guide or core plate, thus eliminating the need for a gantry type bridge and partially submersed mast/manipulator. The above described cutting apparatus does not interfere with overhead crane cables when the crane is used for handling cut pieces of the reactor internal components, or interfere with the service platform which is used by personnel over the cutting area for manipulating rigging and cameras. Additionally, because the collection chamber is an integral component of the cutting apparatus and is supported by the support frame, it is unnecessary to utilize separate collectors mounted separately to the reactor component being cut up.

DETAILED DESCRIPTION OF THE INVENTION

Figure 1:
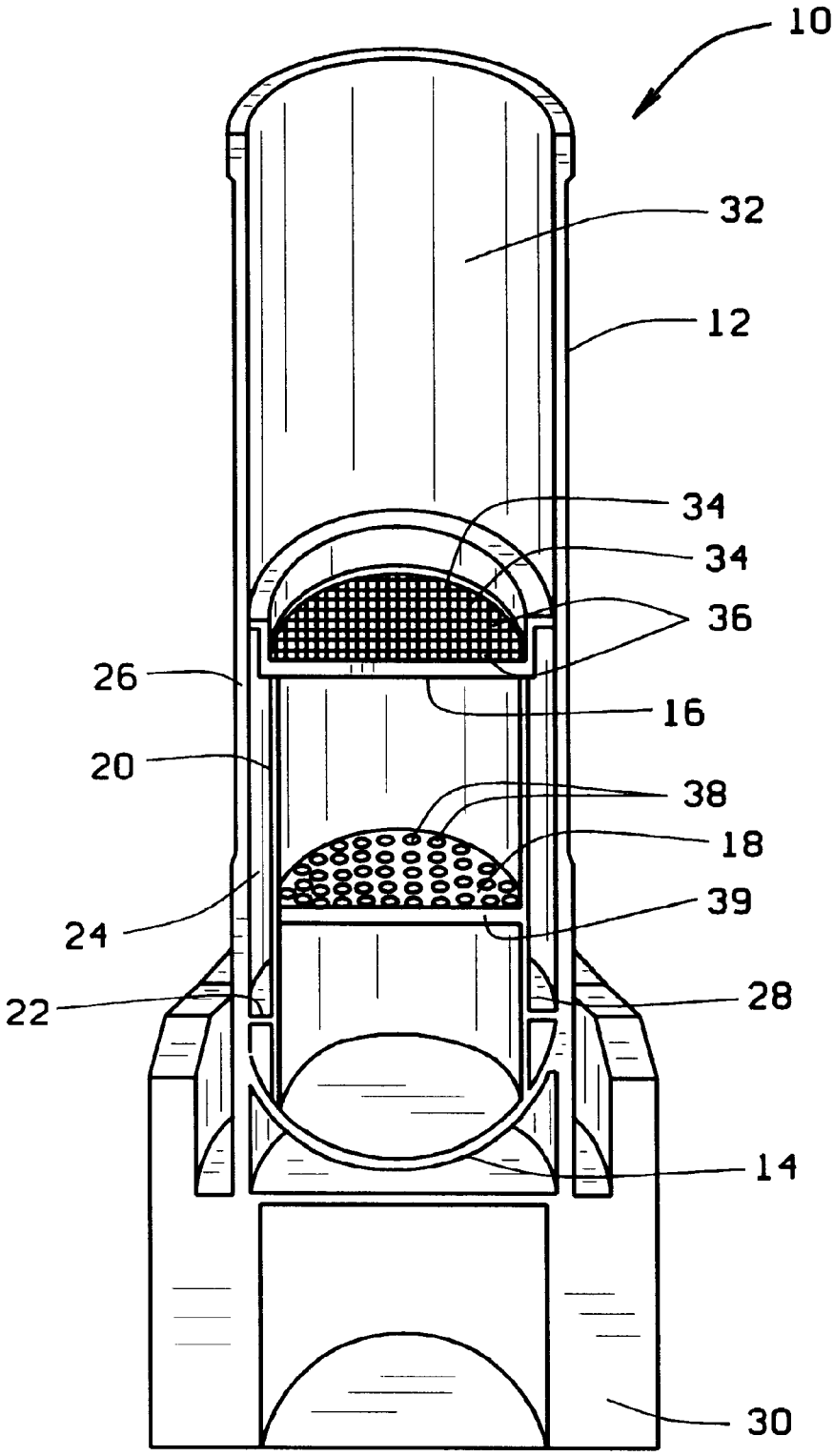
FIG. 1 is a schematic partial cross section, illustration of a boiling water reactor.

FIG. 1 is a schematic, partial cross section, illustration of a boiling water reactor 10 including a reactor pressure vessel (RPV) 12. RPV 12 has a generally cylindrical shape and is closed at one end by a bottom head 14 and at its other end by removable top head (not shown). A top guide 16 is spaced above a core plate 18 within RPV 12. A shroud 20 surrounds core plate 18 and is supported by a shroud support structure 22. An annulus 24 is formed between shroud 20 and a wall 26 of RPV 12. A baffle plate 28, which has a ring shape, extends around RPV 12 between shroud support structure 22 and wall 26 of RPV 12. RPV 12 is supported by an RPV support structure 30. RPV 12, of course, is filled with water.

RPV 12 is shown in FIG. 1 as being shut down with many components removed. For example, and in operation, a plurality of fuel bundles and control rods (not shown) are located in the area between top guide 16 and core plate 18. In addition, and in operation, steam separators and dryers and many other components (not shown) are located in an area 32 above top guide 16.

Top guide 16 is a latticed structure including a plurality of top guide beams 34 defining top guide openings 36. Core plate 18 includes a plurality of openings 38 which are substantially aligned with top guide openings 36 to facilitate positioning the fuel bundles (not shown) between top guide 16 and core plate 18. Core plate 18 also includes a plurality of core plate beams 39 (one shown). Fuel bundles (not shown) are inserted into the area between top guide 16 and core plate 18 by utilizing top guide openings 36 and core plate openings 38. Particularly, each fuel bundle (not shown) is inserted through a top guide opening 36, and is supported horizontally by core plate 18 and top guide beams 34. Shroud 20, core plate 18, and top guide 16 limit lateral movement of the core fuel bundles.

Figure 2:
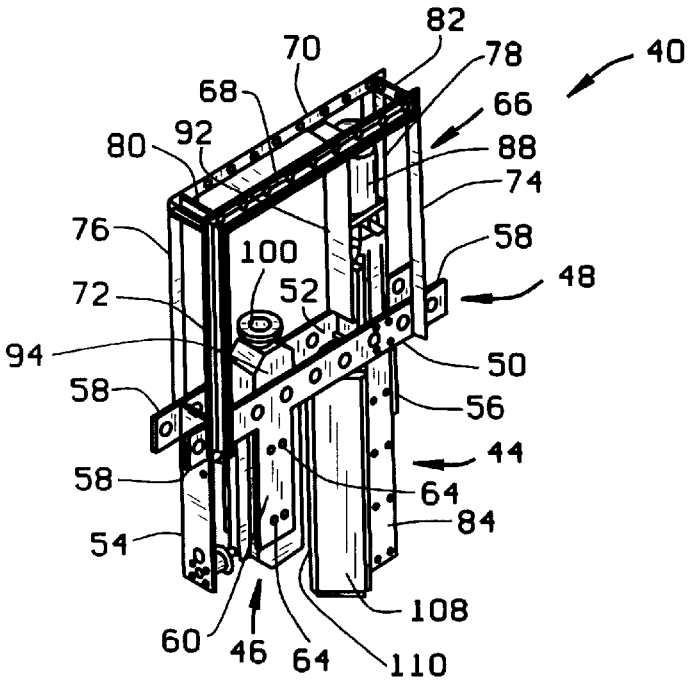
FIG. 2 is a perspective view of an ultra high pressure abrasive waterjet cutting apparatus in accordance with an embodiment of the present invention.
Figure 3:
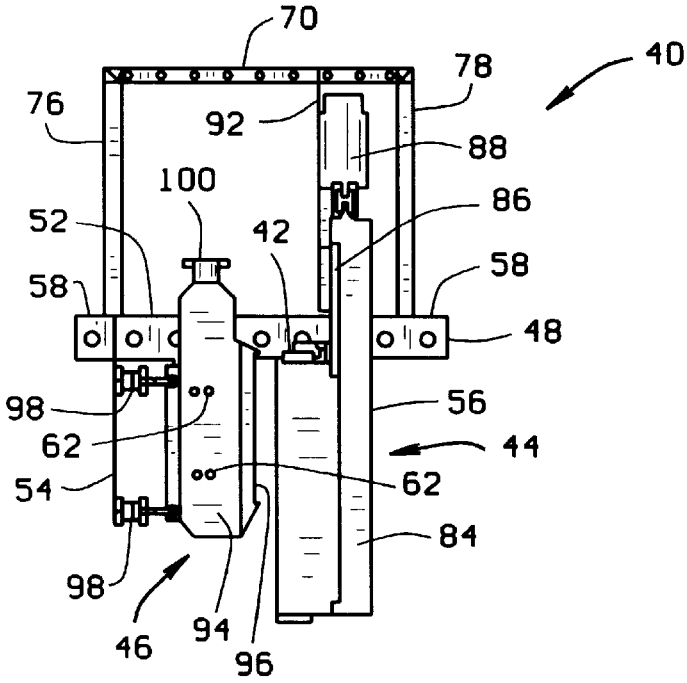
FIG. 3 is a side view, with parts cut away, of the ultra high pressure abrasive watejet cutting apparatus shown in FIG. 2.

FIG. 2 is a perspective view of an ultra high pressure abrasive waterjet cutting apparatus 40, for cutting nuclear reactor structural components, in accordance with an embodiment of the present invention. FIG. 3 is a side view of cutting apparatus 40. Referring to FIGS. 2 and 3, cutting apparatus 40 includes an ultra high pressure abrasive waterjet (UHP) cutting nozzle 42, movably coupled to a single axis manipulator 44, and a collection hood 46. Manipulator 44 and collection hood 46 are coupled to a support frame 48. Support frame 48 is configured to engage the top surface of top guide 16 to support apparatus 40. In an alternate embodiment, described below, support frame 48 is configured to engage the top surface of core plate 18.

Support frame 48 includes a first elongate frame member 50 and a second elongate frame member 52 spaced apart and parallel to each other. Elongate frame members 50 and 52 are joined at each end by first and second end frame members 54 and 56. End frame members 54 and 56 are sized to be located between and attached to elongate frame members 50 and 52. Extension portions 58 at each end of each elongate frame member 50 and 52 extend past end frame members 54 and 56. Further, a collection hood support portion 60 depends from each elongate frame member 50 and 52. Collection hood support portions 60 are configured to couple to collection hood 46 with alignment pins 62 extending from hood 46 though openings 64 in hood support portions 60. Openings 64 are oblong to permit movement of collection hood 46 along the longitudinal axis of elongate frame members 50 and 52.

A hose support frame 66 is attached to support frame 48. Hose support frame 66 has an inverted U-shape and includes horizontal members 68 and 70, with vertical members 72 and 74 depending from opposing ends of horizontal member 68, and vertical members 76 and 78 depending from opposing ends of horizontal member 70. Vertical members 72 and 74 are coupled to elongate frame member 50 of support frame 48, and vertical members 76 and 78 are coupled to elongate frame member 52 of support frame 48. Cross support members 80 and 82 extend between and are coupled to horizontal members 68 and 70 at opposite ends.

Manipulator 44 is coupled to support frame 48. Manipulator 44 includes a linear frame 84, a nozzle support plate 86 movably coupled to linear frame 84, and a motor 88 operatively coupled to nozzle support plate 86. Specifically, a drive belt 90 operatively couples motor 88 and nozzle support plate 86. Motor 88 moves nozzle support plate 86 along linear frame 84. In an alternative embodiment, a ball screw is used to operatively couple motor 88 and nozzle support plate 86. Manipulator 44 also includes a hose support bracket 92 coupled to nozzle support plate 86. Hose support bracket 92 provides support for an ultra high pressure water supply line (not shown) and an abrasive supply line (not shown).

UHP cutting nozzle 42 is coupled to nozzle support plate 86. Ultra high pressure abrasive waterjet cutting typically uses ultra high pressure water of about 40,000 to 80,000 pounds per square inch (2800 to 5600 $Kg/cm^2$) supplied to cutting nozzle 42. Additionally, abrasive material is added to the ultra high pressure water at cutting nozzle 42 at a rate of about 0.05 to 3.0 pounds per minute (22 to 1350 grams/min). A stream of ultra high pressure water including abrasive particles is expelled from cutting nozzle 42 and directed toward the surface of the object to be cut. The impingement of the ultra high pressure water and the abrasive particles cuts through the metal. Cutting nozzle 42 is moved relative to the surface of top guide beam 34 (FIG. 1) by moving nozzle support plate 86 along linear frame 84.

Collection hood 46 includes an elongate collection chamber 94 having an elongate opening 96. Opening 96 is located in chamber 94 so that opening 96 is in alignment with cutting nozzle 42. Collection hood 46 is movably coupled to support frame 48 by positioning cylinders 98 coupled to collection chamber 94 and to end frame member 54. Positioning cylinders 98 are configured to position collection chamber 94 opening 96 adjacent a top guide beam 34 (FIG. 1). Collection hood 46 further includes an outlet port 100 configured to be connected to, and in flow communication with a water filtration system (not shown).

Figure 4:
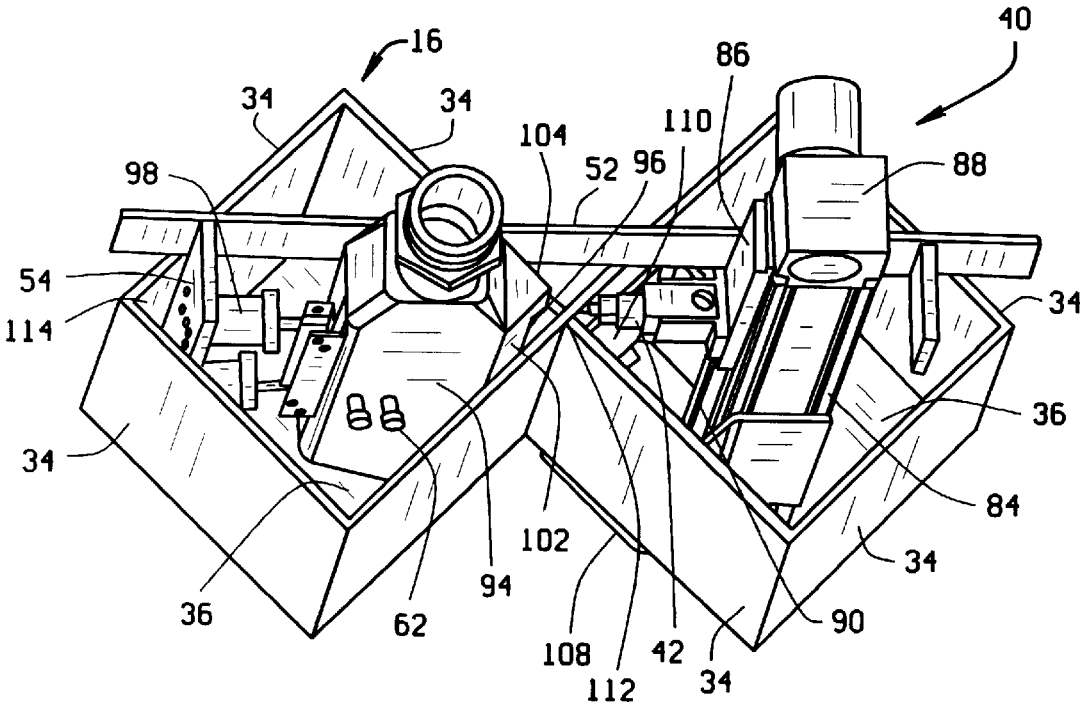
FIG. 4 is a perspective view of an ultra high pressure abrasive waterjet cutting apparatus shown in FIG. 2 located in two adjacent openings of a nuclear reactor top guide.

FIG. 4 is a perspective view of top guide ultra high pressure abrasive waterjet cutting apparatus 40 with manipulator 44 and collection hood 46 located in two adjacent openings 36 of top guide 16. Particularly, in this illustrative embodiment, manipulator 44 and collection hood 46 are configured to be positioned inside diagonally adjacent openings 36 of top guide 16 so that cutting nozzle 42 is in alignment with opening 96 in collection hood 46. Collection hood 46 includes side members 102 and 104 that extend from collection chamber 94 so that the distal ends of side members 102 and 104 intersect at an angle equivalent to the angle that top guide beams 34 intersect. Opening 96 is located along the intersection of side members 102 and 104. The equivalent angles of the intersection of side members 102 and 104 and top guide beams 34 permit collection hood to be positioned in a diagonal corner 106 of opening 36 formed by beams 34. Manipulator includes two positioning guides 108 and 110 extending from linear frame 84. Positioning guides 108 and 110 position cutting nozzle 42 in the diagonal corner of opening 36 on the opposite side of top guide beams 34 as collection chamber 94. Positioning guides 108 and 110 also protect nozzle 42 during installation of apparatus 40 into operational position on top guide 16.

In alternative embodiments, manipulator 44 and collection hood 46 are positioned in adjacent openings 36 that are not diagonal. Manipulator 44 and collection chamber 46 are configured to be located on opposite sides of a top guide beam 34 at a position other than the intersection of two top guide beams 34.

To cut up reactor top guide 16, ultra high pressure abrasive waterjet cutting apparatus 40 is positioned with support frame 42 resting on top guide 16 with manipulator 44 and collection hood 46 in adjacent top guide openings 36. Manipulator 44 and collection hood 46 are in a vertical position and are perpendicular to the top surface of top guide 16. Positioning cylinders 98 are then activated to move collection chamber 94 into engagement with top guide beam 34 with collection chamber opening 96 adjacent top guide beam 34 and in alignment with UHP nozzle 42 on the opposite side of top guide beam 34. Particularly, side members 102 and 104 engage top guide beams 34 at diagonal corner 106 of top guide opening 36. The action of positioning cylinders 98 cause end frame member 54 to engage top guide beams 34 at an opposite diagonal corner 112 of top guide opening 36. The engagement of end frame member and side members 102 and 104 of top guide beams 34 in opposite diagonal corners 112 and 106 respectively clamps cutting apparatus 40 to top guide 16. UHP nozzle 42 is activated and nozzle 42 is moved from a first end 114 of linear frame 84 to a second end 116 of linear frame 84 by activating motor 88 which moves nozzle support plate 86 along linear frame 84. The abrasive containing UHP water jet cuts through top guide beam 34 and enters collection chamber 94 through opening 96 positioned adjacent top guide beam 34. The water filtration system (not shown) connected to collection chamber outlet port 100 filters the used abrasive and kerf material from the water before it is returned to reactor 10 containment pool (not shown).

The above described ultra high pressure abrasive waterjet cutting apparatus 40 is supported by reactor top guide 16 thus eliminating the need for a gantry type bridge and partially submersed mast/manipulator. The above described cutting apparatus 40 does not interfere with overhead crane cables when the crane is used for handling cut pieces of the reactor internal components, or interfere with the service platform which is used by personnel over the cutting area for manipulating rigging and cameras. Additionally, because collection chamber 96 is an integral component of cutting apparatus 40 and is supported by support frame 48, it is unnecessary to utilize separate collectors mounted separately to the reactor component being cut up.

Figure 5:
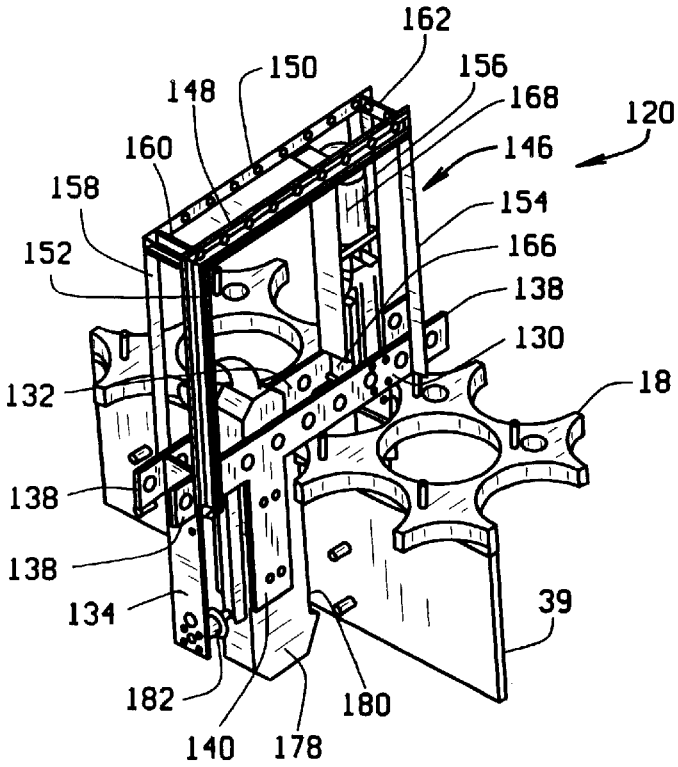
FIG. 5 is a perspective view of an ultra high pressure abrasive waterjet cutting apparatus, in accordance with another embodiment of the present invention, located in two adjacent openings of a nuclear reactor top guide.
Figure 6:
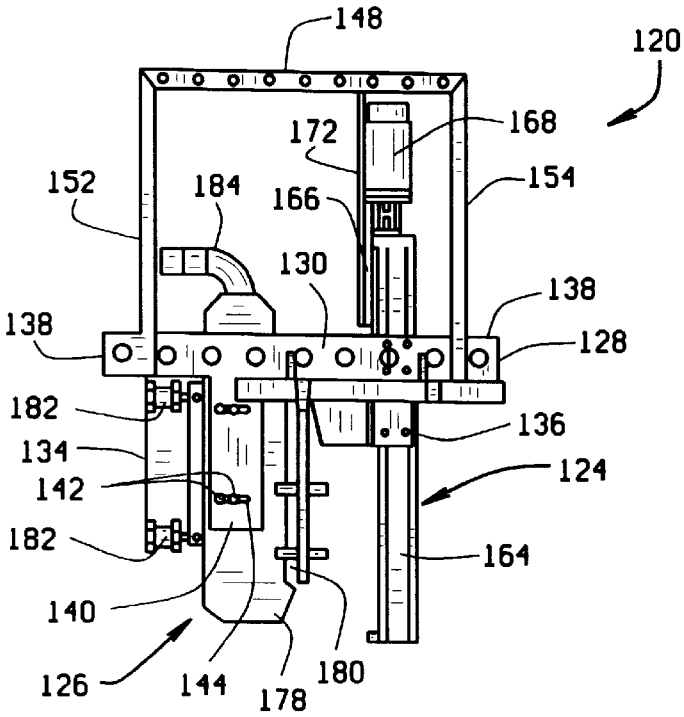
FIG. 6 is a side view, with parts cut away, of the ultra high pressure abrasive waterjet cutting apparatus shown in FIG. 5.
Figure 7:
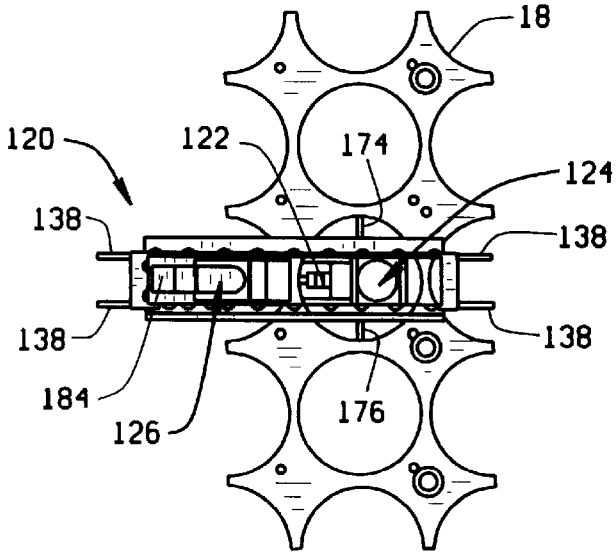
FIG. 7 is a top view of the ultra high pressure abrasive waterjet cutting apparatus shown in FIG. 5.

FIGS. 5, 6, and 7 show another embodiment of an ultra high pressure abrasive waterjet cutting apparatus 120 configured to cut up core plate 18 and core plate beams 39. Cutting apparatus 120 is similar to cutting apparatus 40 described above and includes an ultra high pressure abrasive waterjet (UHP) cutting nozzle 122, movably coupled to a single axis manipulator 124, and a collection hood 126. Manipulator 124 and collection hood 126 are coupled to a support frame 128. Support frame 128 is configured to engage the top surface of core plate 18 to support apparatus 120.

Support frame 128 includes a first elongate frame member 130 and a second elongate frame member 132 spaced apart and parallel to each other. Elongate frame members 130 and 132 are joined at each end by first and second end frame members 134 and 136. End frame members 134 and 136 are sized to be located between and attached to elongate frame members 130 and 132. Extension portions 138 at each end of each elongate frame member 130 and 132 extend past end frame members 134 and 136. Further, a collection hood support portion 140 depends from each elongate frame member 134 and 136. Collection hood support portions 140 are configured to couple to collection hood 126 with alignment pins 142 extending from hood 126 though openings 144 in hood support portions 140. Openings 144 are oblong to permit movement of collection hood 46 along the longitudinal axis of elongate frame members 130 and 132.

A hose support frame 146 is attached to support frame 148. Hose support frame 146 has an inverted U-shape and includes horizontal members 148 and 150, with vertical members 152 and 154 depending from opposing ends of horizontal member 148, and vertical members 156 and 158 depending from opposing ends of horizontal member 150. Vertical members 152 and 154 are coupled to elongate frame member 130 of support frame 128, and vertical members 156 and 158 are coupled to elongate frame member 132 of support frame 128. Cross support members 160 and 162 extend between and are coupled to horizontal members 148 and 150 at opposite ends.

Manipulator 124 is coupled to support frame 128. Manipulator 124 includes a linear frame 164, a nozzle support plate 166 movably coupled to linear frame 164, and a motor 168 operatively coupled to nozzle support plate 166. Specifically, a drive belt 170 operatively couples motor 168 and nozzle support plate 166. Motor 168 moves nozzle support plate 166 along linear frame 164. In an alternative embodiment, a ball screw is used to operatively couple motor 168 and nozzle support plate 166. Manipulator 124 also includes a hose support bracket 172 coupled to nozzle support plate 166. Hose support bracket 172 provides support for an ultra high pressure water supply line (not shown) and an abrasive supply line (not shown). Alignment guides 174 and 176 extend from opposite sides of manipulator 124. Alignment guides 174 and 176 are configured to properly position manipulator 124 within a core plat opening 38.

UHP cutting nozzle 122 is coupled to nozzle support plate 166. Cutting nozzle 122 is moved relative to the surface of core plate beam 39 by moving nozzle support plate 166 along linear frame 164.

Collection hood 126 includes an elongate collection chamber 178 having an elongate opening 180. Opening 180 is located in chamber 178 so that opening 180 is in alignment with cutting nozzle 122. Collection hood 126 is movably coupled to support frame 128 by positioning cylinders 182 coupled to collection chamber 178 and to end frame member 134. Positioning cylinders 182 are configured to position collection chamber opening 180 adjacent a core plate beam 39. Collection hood 126 further includes an outlet port 184 configured to be connected to, and in flow communication with a water filtration system (not shown).

While the invention has been described and illustrated in terms of various specific embodiments, those skilled in the art will recognize that the invention can be practiced with modification within the spirit and scope of the claims.

What is claimed is:

1. A cutting apparatus for cutting of structural components in a nuclear reactor, the reactor including a top guide having a top surface and comprising a plurality of interconnecting beams forming a plurality of openings, and a core plate having a top surface, a plurality of openings and a plurality of support beams, said cutting apparatus comprising:

an ultra high pressure abrasive waterjet cutting nozzle movably coupled to a single axis manipulator; and a collection hood, said manipulator and said collection hood configured to be positioned inside adjacent openings in at least one of the top guide and the core plate, so that said cutting nozzle is in alignment with said collection hood, said collection hood comprises an elongate collection chamber having an elongate opening, said elongate opening located to be in alignment with said cutting nozzle.

2. A cutting apparatus in accordance with claim 1 further comprising a support frame, said manipulator coupled to said support frame, said collection hood movable coupled to said support frame, and said support frame configured to engage the top surface of at least one of the top guide and the core plate.

3. A cutting apparatus in accordance with claim 1 wherein said manipulator comprises:

a linear frame;

a nozzle support plate movably coupled to said linear frame, said cutting nozzle coupled to said nozzle support plate; and a motor operatively coupled to said nozzle support plate.

4. A cutting apparatus in accordance with claim 3 wherein said motor is operatively coupled to said nozzle support plate with a drive belt or a ball screw.

5. A cutting apparatus in accordance with claim 3 wherein said nozzle support plate is movable from a first end to a second end of said linear frame.

6. A cutting apparatus in accordance with claim 1 wherein said collection hood further comprises at least one positioning cylinder coupled to said collection chamber and to said support frame, said positioning cylinder configured to position said collection chamber opening adjacent of at least one of a top guide beam and a core plate beam.

7. A cutting apparatus in accordance with claim 6 wherein said collection hood further comprises an outlet port.

8. A cutting apparatus for underwater cutting of structural components in a nuclear reactor, the reactor including a top guide comprising a plurality of interconnecting beams forming a plurality of openings, and a core plate having a plurality of openings and a plurality of support beams, said cutting apparatus comprising:

a support frame configured to engage at least one of the top guide and the core plate;

a single axis manipulator coupled to said support frame;

an ultra high pressure abrasive waterjet cutting nozzle movably coupled to said manipulator; and a collection hood movably coupled to said support frame, said collection hood having an opening located so as to be in alignment with said cutting nozzle, said collection hood and said manipulator configured to be positioned inside adjacent openings of at least one of the top guide and the core plate, said collection hood comprises an elongate collection chamber having an elongate opening, said elongate opening located to be in alignment with said cutting nozzle.

9. A cutting apparatus in accordance with claim 8 wherein said manipulator comprises:

a linear frame;

a nozzle support plate movably coupled to said linear frame, said cutting nozzle coupled to said nozzle support plate; and a motor operatively coupled to said nozzle support plate.

10. A cutting apparatus in accordance with claim 9 wherein said motor is operatively coupled to said nozzle support plate with a drive belt or a ball screw.

11. A cutting apparatus in accordance with claim 9 wherein said nozzle support plate is movable from a first end to a second end of said linear frame.

12. A cutting apparatus in accordance with claim 8 wherein said collection hood further comprises at least one positioning cylinder coupled to said collection chamber and to said support frame, said positioning cylinder configured to position said collection chamber opening adjacent at least one of a top guide beam and a core plate beam.

13. A cutting apparatus in accordance with claim 12 wherein said collection hood further comprises an outlet port.

* * * * *